United States Patent [19]

Morishita

[11] Patent Number: 4,902,905

[45] Date of Patent: Feb. 20, 1990

[54] PINION STOPPER ARRANGEMENT FOR STARTER MOTOR

[75] Inventor: Akira Morishita, Himeji, Japan

[73] Assignee: Mitsubishi Denki Kabushiki Kaisha, Tokyo, Japan

[21] Appl. No.: 289,151

[22] Filed: Dec. 23, 1988

[30] Foreign Application Priority Data

Dec. 26, 1987 [JP] Japan ..... 62-331166

[51] Int. Cl.[4] ..... F02N 11/00

[52] U.S. Cl. ..... 290/48; 74/7 A

[58] Field of Search ..... 290/48; 74/7 R, 7 A, 74/7 B, 7 C

[56] References Cited

U.S. PATENT DOCUMENTS

| | | | |
|---|---|---|---|
| 2,753,720 | 7/1956 | Buxton et al. | 74/7 B |
| 4,677,407 | 6/1987 | Tanaka et al. | 335/202 |
| 4,818,889 | 4/1989 | Kinoshita | 290/48 |
| 4,825,095 | 4/1989 | Morishita et al. | 290/48 |
| 4,829,195 | 5/1989 | Takami | 290/48 |
| 4,843,897 | 7/1989 | Tallis, Jr. | 74/7 A X |

FOREIGN PATENT DOCUMENTS 55-53727 12/1980 Japan .

*Primary Examiner*—A. D. Pellinen
*Assistant Examiner*—W. E. Duncanson, Jr.
*Attorney, Agent, or Firm*—Sughrue, Mion, Zinn, Macpeak and Seas

[57] ABSTRACT

A pinion stopper arrangement for a starter motor comprises a motor output shaft having a circumferential projection and a coaxial pinion shaft rotatably supported on the output shaft. Two shafts are connected by an over-running clutch having a clutch outer member connected to the output shaft by helical splines and a clutch inner member directly connected to the pinion shaft. An elastic stopper ring is snap fitted between the clutch outer member and the circumferential projection on the output shaft, so that the elastic stopper ring, in cooperation with the circumferential projection on said output shaft, restricts the axial movement of the over-running clutch and the pinion gear relative to the output shaft.

12 Claims, 5 Drawing Sheets

PINION STOPPER ARRANGEMENT FOR STARTER MOTOR

BACKGROUND OF THE INVENTION

This invention relates to a pinion stopper arrangement for a starter motor which enables to shorten the axial length of the rotary output shaft and to have a stopper with a simple structure.

FIG. 1 is a sectional view of a conventional pinion stopper arrangement for a starter motor disclosed in Japanese Utility Model Laid-Open No. 55-53727, and FIG. 2 is a sectional view taken along line II-II of FIG. 1. In FIGS. 1 to 4, an output shaft 2 of an armature 1 to be driven by a magnetic field unit has a large-diameter step portion 2A, and helical splines 3 are formed in the outer periphery of the step portion 2A.

To the helical splines 3, a spline tube 5 of a pinion mechanism composed of a pinion 4, the spline tube 5, an over-running clutch 6 is thread-engaged so as to be movable in the axial direction.

As best seen in FIG. 4, the output shaft 2 of the armature 1 has formed thereon the large-diameter step portion 2A in which the helical splines 3 are formed and a small-diameter escape portion 2B in which an inner helical splines 5A of the spline tube 5 can be rotated.

The length $L_1$ of the escape portion 2B is longer than the length $L_2$ of the inner helical spline 5A and has a smaller inner diameter than the helical spline 3.

Also, as apparent from FIG. 2, the helical spline 3 is formed by providing the step portion 2A with a plurality of first grooves 2C helically extending over the entire axial length of the large-diamter portion 2A and a plurality of second grooves 2D extending parallel to the first grooves 2C but has shorter length.

In the intermediate portion of the step portion 2A, an annular groove 17 is formed, in which a clip 19 as shown in FIG. 3 having inwardly bent portions 18 at a pitch substantially equal to that of the inner helical splines 5A of the spline tube 5 is engaged as shown in FIG. 1.

As is well known, the starter motor comprises a shift lever 10, a solenoid switch 12, a plunger 13, a torsion spring 14, a gear case 15, a ring gear 16 and a center plate 20.

In the structure as above described, the pinion mechanism is first assembled. After the clip 19 is fitted in the annular groove 17 of the step portion 2A of the output shaft 2, the ridge portions of the inner helical spline 5A of the spline tube 5 of the pinion mechanism are correspondingly positioned with respect to the inwardly bent portions 18 and inserted from the side of the ring gear 16 until the inner helical spline 5A is positioned within the reduced-diameter escape portion 2B of the output shaft 2. Then, when the splines are disengaged from each other, two splined members are rotated relative to each other by an angle corresponding to one ridge.

This causes the ridge portion of the helical splines 5A to abut against one end of the clip 19, whereby the pinion mechanism cannot be dislodged from the output shaft 2.

Since the pinion stopper mechanism of the conventional starter motor is constructed as above described, the output shaft 2 must have the escape portion 2B for allowing the inner helical splines 5A of the spline tube 5 to be rotated therein, making the axial dimension of the output shaft 2 enevitably large.

Also, the second shorter grooves 2D for preventing the movement of the inner helical spline 5A of the spline tube 5 must be formed in the output shaft 2 independently of the first groove 2C, making numbers of the manufacturing steps large and difficult.

SUMMARY OF THE INVENTION

Accordingly, an object of this invention is to provide a pinion stopper arrangement for a starter motor free from the above-discussed problems of the conventional stopper arrangement.

Another object of the present invention is to provide a pinion stopper arrangement for a starter motor of which axial dimension of the output shaft is reduced.

A further object of the present invention is to provide a pinion stopper arrangement for a starter motor which is simple in structure and easy to manufacture.

With the above objects in view, the pinion stopper arrangement for a starter motor comprises an elastic stopper ring disposed between a front end surface of a clutch outer member and a vertical rear end surface of a cicumferential projecting portion mounted on an output shaft. The elastic stopper ring is expanded when it is urged against the circumferential projection on the output shaft to pass over the circumferential projection, but is prevented from returning by passing over again the circumferential projection. According to the present invention, when the pinion drive shaft is driven forward, the clutch outer member of the over-running clutch abuts against the circumferential projection portion of the output rotary shaft through the elastic stopper ring. Therefore, the forward movement of the pinion drive shaft and the pinion relative to to the output shaft can be prevented.

BRIEF DESCRIPTION OF THE DRAWINGS

The present invention will become more readily apparent from the following detailed description of the preferred embodiments of the present invention taken in conjunction with the accomapnying drwings, in which.

DESCRIPTION OF THE PREFERRED EMBODIMENTS

Figure 1:
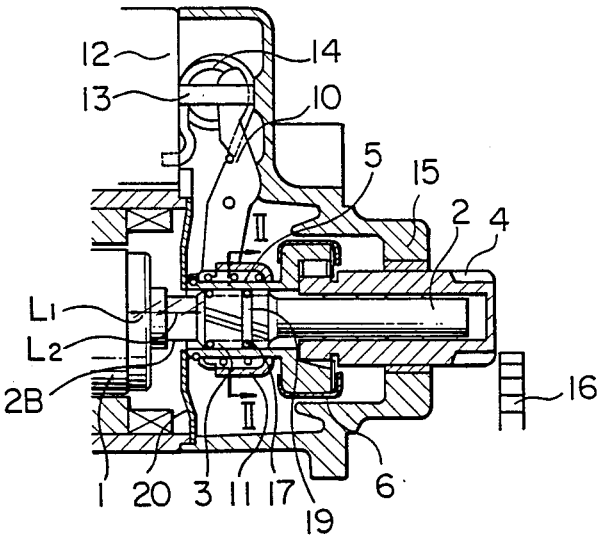
FIG. 1 PRIOR ART
FIG. 1 is a sectional view of the conventional pinion stopper arrangement for a starter motor.
Figure 2:
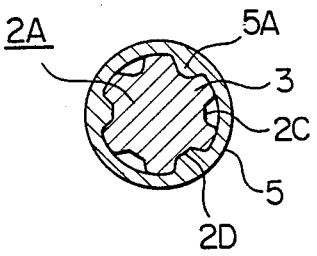
FIG. 2 PRIOR ART
FIG. 2 is a sectional view taken along line II—II of FIG. 1.
Figure 3:
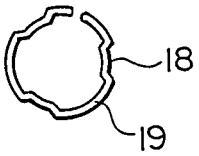
FIG. 3 PRIOR ART
FIG. 3 is a front view of the pinion stopper clip shown in FIG. 1.
Figure 4:
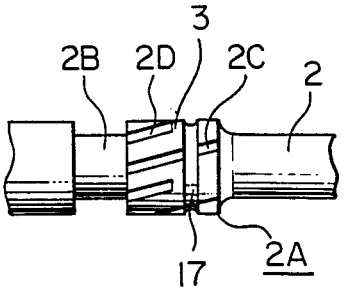
FIG. 4 PRIOR ART
FIG. 4 is a side view of the shaft helical spline portion of another conventional pinion stopper arrangement for the starter motor.
Figure 5:
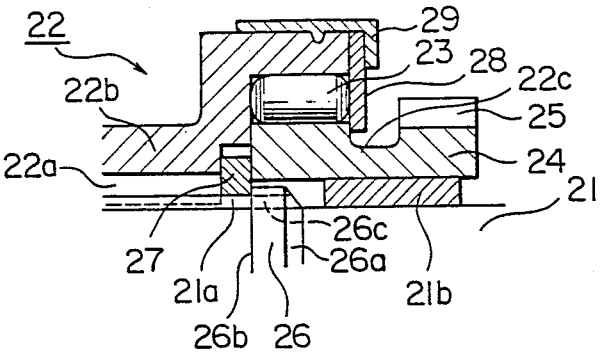
FIG. 5 is a sectional view of one embodiment of the pinion stopper arrangement for a starter motor of the present invention.

FIG. 5 illustrates in section one embodiment of the pinion stopper arrangement for a starter motor of the present invention. In FIG. 5, the arragement comprises an output rotary shaft 21 connected at its rear end (the left end in FIG. 5) to an unillustrated armature rotary shaft of an electric motor for rotation therewith.

The output rotary shaft 21 has formed on its outer periphery helical splines 21*a* which mesh with the helical splines 22*a* of the over-running clutch 22.

A clutch outer member 22*b* is coupled with a clutch inner member 22*c* through rollers 23. The clutch inner member 22*c* is formed integral with the pinion drive shaft 24. A pinon gear 25 is disposed on the front end of the pinion drive shaft 24.

Disposed between the pinion drive shaft 24 and the output shaft 21 is a bearing 21*b* which allows the pinion drive shaft 24 to rotate and axially slide relative to the output shaft 21.

According to the present invention, the pinion stopper arrangement comprises an annular circumferential projection or a ring 26 integrally formed on the output shaft 21. The circumferential projection 26 has a bevelled front end surface 26*a* and a flat rear end surface 26*b* extending substantially perpendicularly to the axis of the output shaft 21. The circumferential projection 26 has also formed therein a plurality of substantially axially extending grooves 26*c* for allowing the passage therethrough of the helical splines 22*a* of the clutch outer member 22*b*.

Also according to the present invention, an elastic stopper ring 27 is placed over the output shaft 21 between the vertical rear end (left end in FIG. 5) surface 26*b* of the circumferential projection 26 and the front end (right end in FIG. 5) surface 22*e* of the clutch outer member 22*b*. This ring-shaped stopper ring 27 is configured as shown in the plan view of FIG. 7. It is seen from FIG. 5 that the elastic stopper ring 27 is made of a spring steel for example and has an inner diameter smaller than the outer diameter of the circumferencial projection 26 and an outer diameter larger than the diameter of the dedendum circle of the helical spline 22*a* of the clutch outer member 22*b*. In the illustrated embodiment, the elastic stopper ring 27 is firmly attached to the front end surface 22*e* of the clutch outer member 22*b* such as by welding.

Figure 6:
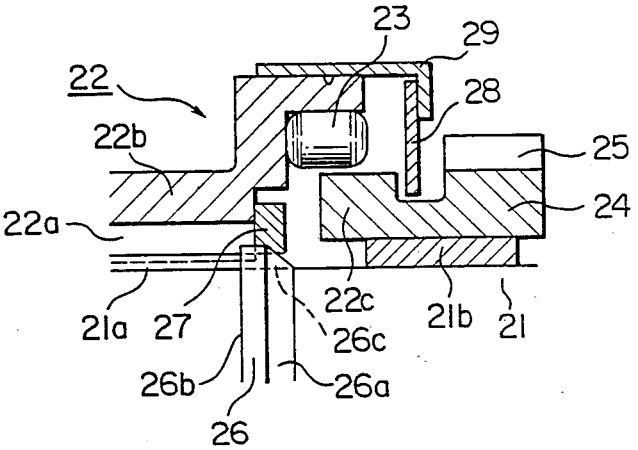
FIG. 6 is a sectional view showing how the over-running clutch is inserted onto the output shaft of the embodiment shown in FIG. 5.

FIG. 6 is a sectional view showing the manner in which this embodiment of the present invention is assembled. As shown in FIG. 6, the half-assembled over-running clutch 22 is placed and advanced over the output shaft 21 from its front end or from right side in FIG. 6.

During this fitting operation, the over-running clutch 22 can be smoothly moved toward the rear end of the output shaft 21 with the helical splines 22*a* of the clutch outer memeber 22*b* are mesh with the helical splines 21*a* of the output shaft 21 as well as the axial grooves 26*c* formed in the circumferential projection 26 until the elastic stopper ring 27 is brought into contact with the annular ring formed on the output shaft 21. By further forcedly advancing the over-running clutch 22, the elastic stopper ring 27 is forcedly expanded to increase its inner diameter to such an extent that the elastic stopper ring 27 can override the annular ring 26 owing to the sloped or bevelled surface 26*a* of the annular ring 26 and the elasticity of the stopper ring 27. Once the elastic stopper ring 27 has passed over the annular ring 26, it returns to the original diametrical dimension and is held between the front end surface 22*e* of the clutch outer member 22*b* and the rear end surface 26*b* of the annular ring 26 as shown in FIG. 5. Thus, the clutch outer member 22*b* and therefore the over-running clutch 22 is prevented from forwardly moving on the output shaft 21. In this context, the elastic stopper ring 27 is a stopper for the over-running clutch 22.

The over-running clutch 22 further comprises a ring shaped seal plate 28 held by a cover 29 fitted over the clutch outer member 22*b*.

Figure 7:
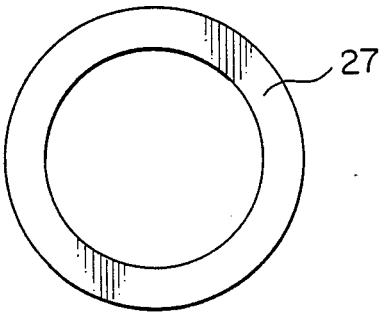
FIG. 7 is an enlarged plan view of the ring-shaped member of the embodiment shown in FIG. 5.
Figure 8:
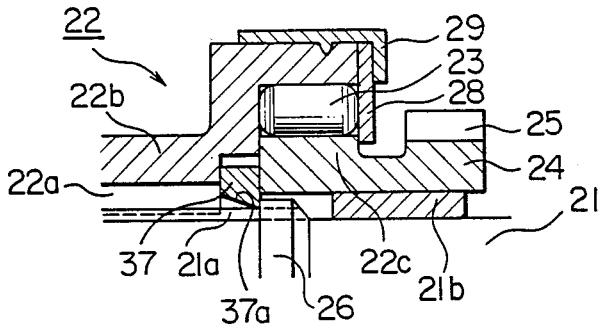
FIG. 8 is a sectional view of another embodiment of the present invention.
Figure 9:
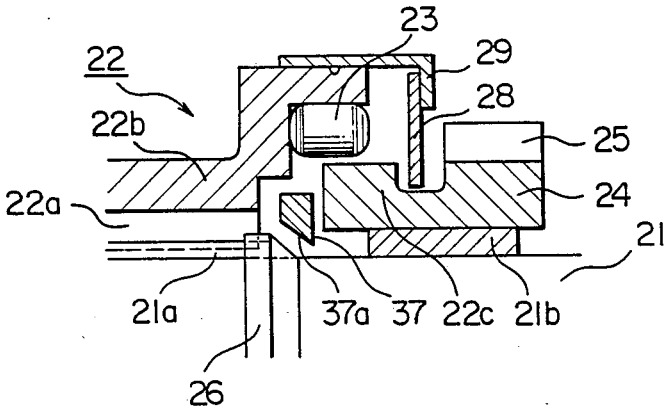
FIG. 9 is a plan view showing how the over-running clutch is inserted onto the output shaft in the embodiment shown in FIG. 8.
Figure 10:
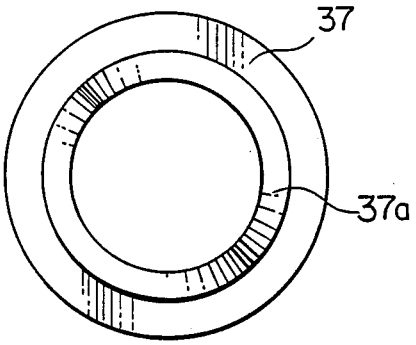
FIG. 10 is an enlarged plan view of the ring-shaped member of the embodiment shown in FIG. 8.

Another embodiment of the pinion stopper arrangement of the present invention is illustrated in FIGS. 8 to 10, from which it is seen that the pinion stopper arrangement comprises an elastic stopper ring 37 similar to the ring-shaped member 27 of the previous embodiment shown in FIGS. 5 to 7. The elastic stopper ring 37 is different from the elastic stopper ring 27 in that it has a bevelled inner circumferential surface 37*a* so that the expansion of the elastic stopper ring 37 by the forced advancement over the sloped surface 26*a* of the circumferentail projection 26 may be easier than that of the previous embodiment. The elastic stopper ring 37 is also different from the elastic stopper ring 27 in that it is not secured such as by welding to the clutch outer member 22*b* to provide a higher flexibility to the elastic stopper ring 37. In other respects, the arrangement is the same to that of the previous embodiment.

Figure 11:
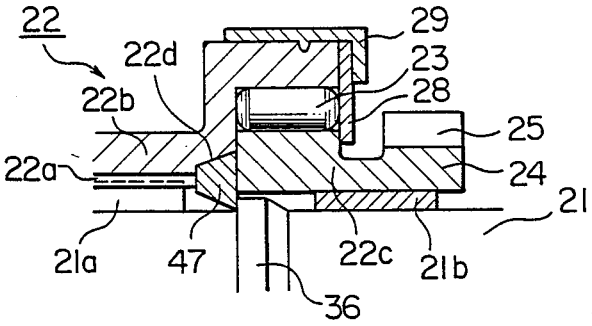
FIG. 11 is a sectional view of still another embodiment of the present invention.
Figure 12:
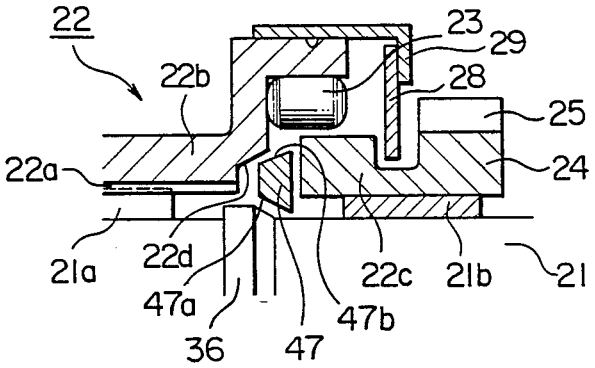
FIG. 12 is a plan view showing how the over-running clutch is inserted onto the output shaft in the embodiment shown in FIG. 11.
Figure 13:
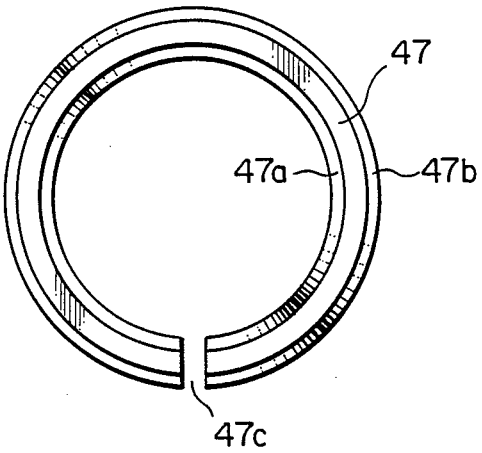
FIG. 13 is an enlarged plan view of the ring-shaped member of the embodiment shown in FIG. 11.

FIG. 11 to 13 illustrate still another embodiment of the pinion stopper arrangement of the present invention, from which it is seen that the pinion stopper arrangement comprises an elastic stopper ring 47 similar to the elastic stopper ring 27 of the previous embodiment shown in FIGS. 5 to 7. This elastic stopper ring 47 is made of a relatively hard material such as a spring steel, so that a gap 47*c* for providing necessary flexibility for overrinding the circumferencial projection 26 is formed in the ring 47. The elastic stopper ring 47 also has an inner bevelled circumferential surface 47*a* surface 47*a* and an outer bevelled circumferential surface 47*b*. The bevelled surface 47*a* has the same function as the bevelled surface 37*a* of the elastic ring member 37 shown in FIGS. 8 to 10, and the bevelled surface 47*b* is formed to be press-fit by a correspondingly bevelled surface 22*d* of the clutch outer member 22*b*.

In this embodiment, it is seen that the diameter of the addendum circle of the helical splines 22*a* of the outer clutch member 22*b* is larger than the outer diameter of the circumferential projection 36. Therefore, no axial grooves such as those corresponding to the axial grooves 26*c* provided in the previous embodiments shown in FIGS. 5 to 10 for allowing the passage of the helical splines 22*a* therethrough is necessary. Thus, the circumferential projection 46 of this embodiment has a continuous outer surface.

Figure 14:
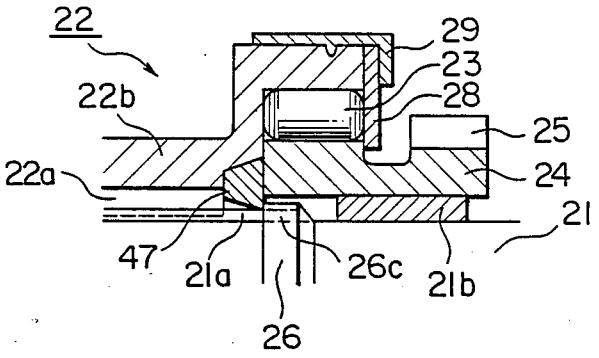
FIG. 14 is a sectional view of another embodiment of the present invention.
Figure 15:
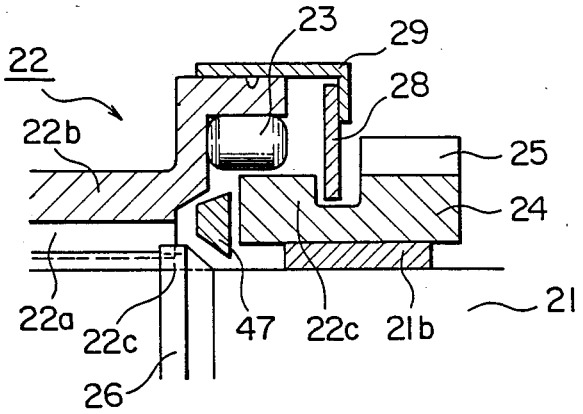
FIG. 15 is a plan view showing how the over-running clutch is inserted onto the output shaft in the embodiment shown in FIG. 14.

FIGS. 14 and 15 illustrate another embodiment of the pinion stopper arrangement of the present invention.

The arrangement of this embodiment is identical to that shown in FIGS. 11 to 13 except that the inner diameter of the splined clutch outer member 22*b* is smaller than the outer diameter of the circumferential projection 26 and that the circumferential projection 26 has the axial grooves 26*c* for allowing the passage of the helical splines 22*a* fo the clutch outer member 22*b*.

As has been described, the pinion stopper arrangment for a starter motor of the present invention comprises an elastic stopper ring disposed between a front end surface of a clutch outer member and a vertical rear end surface of a cicumferential projecting portion mounted on an output shaft. The elastic stopper ring is expanded when it is urged against the circumferential projection, but is shaft to pass over the circumferential projection, but is prevented from returning by passing over again the circumferential projection. When the pinion drive shaft is driven forward, the clutch outer member of the over-running clutch abuts against the circumferential projection portion of the output rotary shaft through the elastic stopper ring. Therefore, the forward movement of the pinion drive shaft and the pinion relative to to the output shaft can be prevented with a relatively simple structure which can be manufactured and assembled with ease. The axial length of the output shaft can be shortened.

What is claimed is:

1. A pinion stopper arrangement for a starter motor comprising:

a motor output shaft driven by an electric motor and having a circumferentially extending projection, said circumferential projection having a front end surface facing away from said electric motor and a rear end surface facing toward said electric motor and being substantially perpendicular to the axis of said output shaft;

a pinion drive shaft having a pinion gear thereon;

an over-running clutch having a clutch outer member having a front end surface facing away from said electric motor and engaged with said helical splines on said output shaft and a clutch inner member mounted on said pinion drive shaft for rotation therewith, said clutch outer member and said clutch inner member being relatively rotatable but substantially immovable in the axial direction relative to each other; and an elastic stopper ring disposed between said front end surface of said clutch outer member and said rear end surface of said circumferential projection on said output shaft, said elastic stopper ring having an inner diameter smaller than the outer diameter of said circumferential projection, and said elastic stopper ring, in cooperation with said circumferential projection on said output shaft, restricting the axial movement of said over-running clutch and said pinion gear relative to said outer shaft.

2. A pinion stopper arrangement for a starter motor as claimed in claim 1, wherein said front end surface of said circumferential projection is bevelled.

3. A pinion stopper arrangement for a starter motor as claimed in claim 1, wherein said circumferential projection on said output shaft has an outer diameter larger than the inner diameter of said clutch outer member, and said circumferential projection has formed therein grooves for allowing the passage of said helical splines of said clutch outer member.

4. A pinion stopper arrangement for a starter motor as claimed in claim 1, wherein said circumferential projection on said output shaft has an outer diameter smaller than the inner diameter of said clutch outer member, and said circumferential projection has a continuous outer circumferential surface.

5. A pinion stopper arrangement for a starter motor as claimed in claim 1, wherein said elastic stopper ring is a closed ring member.

6. A pinion stopper arrangement for a starter motor as claimed in claim 1, wherein said elastic stopper ring is an open ring member having a gap for allowing easy expansion of the stopper ring.

7. A pinion stopper arrangement for a starter motor as claimed in claim 1, wherein said elastic stopper ring is an open ring member made of a spring steel and having a gap for allowing easy expansion of the stopper ring.

8. A pinion stopper arrangement for a starter motor as claimed in claim 1, wherein said elastic stopper ring has a substantially rectangular cross-section.

9. A pinion stopper arrangement for a starter motor as claimed in claim 1, wherein said elastic stopper ring has a bevelled inner circumferential surface.

10. A pinion stopper arrangement for a starter motor as claimed in claim 1, wherein said elastic stopper ring has a bevelled inner circumferential surface and a bevelled outer circumferential surface, and said clutch outer member has a bevelled inner circumferential surface corresponding to said bevelled outer circumferential surface of said elastic stopper ring.

11. A pinion stopper arrangement for a starter motor as claimed in claim 1, wherein said elastic stopper member is attached to said front end surface of said clutch outer member.

12. A pinion stopper arrangement for a starter motor as claimed in claim 10, wherein said circumferential projection on said output shaft has an outer diameter larger than the inner diameter of said clutch outer member, and said circumferential projection has formed therein grooves for allowing the passage of said helical splines of said clutch outer member.

* * * * *